US008284147B2

(12) United States Patent
Weng

(10) Patent No.: US 8,284,147 B2
(45) Date of Patent: Oct. 9, 2012

(54) SOURCE DRIVER, DISPLAY DEVICE USING THE SAME AND DRIVING METHOD OF SOURCE DRIVER

(75) Inventor: Meng-Tse Weng, Tainan County (TW)

(73) Assignee: Himax Technologies Limited, Tainan (TW)

( * ) Notice: Subject to any disclaimer, the term of this patent is extended or adjusted under 35 U.S.C. 154(b) by 954 days.

(21) Appl. No.: 12/345,223

(22) Filed: Dec. 29, 2008

(65) Prior Publication Data

US 2010/0164925 A1 Jul. 1, 2010

(51) Int. Cl.
*G09G 3/36* (2006.01)

(52) U.S. Cl. ..... 345/98; 345/100

(58) Field of Classification Search ..... 345/87–100, 345/204

See application file for complete search history.

(56) References Cited

U.S. PATENT DOCUMENTS

| | | | | |
|---|---|---|---|---|
| 2003/0151584 | A1 * | 8/2003 | Song et al. | 345/100 |
| 2008/0204434 | A1 * | 8/2008 | Lee et al. | 345/87 |
| 2009/0021507 | A1 * | 1/2009 | Bae et al. | 345/87 |

FOREIGN PATENT DOCUMENTS

| | | |
|---|---|---|
| CN | 1427391 | 7/2003 |

OTHER PUBLICATIONS

"First Office Action of China Counterpart Application", issued on Aug. 17, 2011, p. 1-p. 9, in which the listed reference was cited.

* cited by examiner

*Primary Examiner* — Regina Liang
(74) *Attorney, Agent, or Firm* — J.C. Patents

(57) ABSTRACT

A source driver, a display device and a driving method of the source driver are disclosed. The source driver adapted to a display panel includes a plurality of driving channels, wherein the display panel includes N pixel cells on each of a plurality of scan lines. The $1^{st}$ driving channel to the $N^{th}$ driving channel respectively drive the N pixel cells on a first scan line of the scan lines during a first scan period and the $2^{nd}$ driving channel to the $(N+1)^{th}$ driving channel respectively drive the N pixel cells on a second scan line of the scan lines during a second scan period. When polarity inversion is performed on the display panel, each driving channel is responsible for outputting a data driving voltage with a certain polarity to the corresponding pixel cell during different scan periods. Therefore, the power consumption of the source driver can be decreased.

8 Claims, 5 Drawing Sheets

SOURCE DRIVER, DISPLAY DEVICE USING THE SAME AND DRIVING METHOD OF SOURCE DRIVER

BACKGROUND OF THE INVENTION

1. Field of the Invention

The present invention relates to a source driver, a display device using the same and a driving method of the source driver, and more particularly, to a source driver utilizing a plurality of driving channels, each of which is responsible for outputting a plurality of data driving voltages with same polarity during different scan periods, to perform dot inversion on a display panel.

2. Description of Related Art

FIG. 1 is a schematic diagram of a liquid crystal display (LCD) device. The LCD device 100 includes a gate driver 110, a source driver 120 and a display panel 130. The display panel 130 includes a plurality pixel cells 131 arranged in array manner, and each pixel cell 131 is coupled to one of the scan lines 131 and one of the data lines 121. When a certain scan line 131 is asserted by the gate driver 110, the source driver 120 provides the driving voltages to the pixel cells 131 on the certain scan line 131 via the data lines 121. The source driver 120 is an important component in the driving system of the LCD device 100, which converts a digital data signal corresponding to the pixel cell 131 into the driving voltage, and provides the driving voltage to the pixel cell 131 for controlling the rotation of the liquid crystal corresponding to the pixel cell 131.

As known, the rotation direction of the liquid crystal is related to the electric field direction applied on the liquid crystal. In order to eliminating the DC residual voltage stored within the liquid crystal and avoiding the polarization of the liquid crystal, the LCD device 100 should be driven by polarity inversion. That is to say the driving voltages with different polarities, e.g. positive polarity and negative polarity, are alternatively provided to the pixel cell 131 in different frame periods. There are several kinds of polarity inversion, e.g. column inversion, row inversion, frame inversion and dot inversion.

Referring to FIG. 1, with regard to dot inversion, two adjacent pixel cells 131 are driven by the driving voltages with different polarities, wherein "+" is denoted as positive polarity and "−" is denoted as negative polarity. Each driving channel of the source driver 120 should respectively provide the driving voltage with positive polarity and the driving voltage with negative polarity in two sequential scan periods. The voltage swing range between the positive polarity voltage and the negative polarity voltage is high and results in increasing power consumption of the source driver 120 and temperature of the LCD device 100.

Performing column inversion or frame inversion on the LCD device 100 can save power since each driving channel of the source driver provides the driving voltages with same polarity in different scan periods. However, the LCD device 100 driven by dot inversion still has better display quality than that driven by others due to several advantages, such as low occurrence probability of cross talk and flicker. Therefore, considering with the driving of dot inversion, the design of the source driver should overcome the problem of power consumption.

SUMMARY OF THE INVENTION

The present invention provides a source driver and a driving method thereof. The source driver can perform dot inversion on a display panel by utilizing a plurality of driving channels, wherein each driving channel outputs a plurality of data driving voltages with same polarity for saving power consumption. Besides, the present invention further provides a display device using the said source driver, and the display device has the said advantages.

A source driver adapted to a display panel is provided in the present invention, wherein the display panel includes N pixel cells on each of a plurality of scan lines and N is a positive integer. The source driver includes a plurality of driving channel. The N pixel cells on a first scan line of the scan lines are respectively driven by the $1^{st}$ driving channel to the $N^{th}$ driving channel during a first scan period, and the N pixel cells on a second scan line of the scan lines are respectively driven by the $2^{nd}$ to the $(N+1)^{th}$ driving channel during a second scan period.

In an embodiment of the foregoing source driver, the odd-numbered driving channels respectively output a plurality of data driving voltages of a first polarity, and the even-numbered driving channels respectively output a plurality of data driving voltages of a second polarity.

A driving method of a source driver including a plurality of driving channels is provided in the present invention. The driving method is adapted to drive a display panel including N pixel cells on each of a plurality of scan lines, wherein N is a positive integer. A plurality of data driving voltages are transmitted to the N pixel cells on a first scan line of the scan lines via the $1^{st}$ driving channel to the $N^{th}$ driving channel of the source driver during a first scan period. The data driving voltages are transmitted to the N pixel cells on a second scan line of the scan lines via the $2^{nd}$ driving channel to the $(N+1)^{th}$ driving channel of the source driver during a second scan period.

In an embodiment of the foregoing driving method, the data driving voltages transmitted via the odd-numbered driving channels of the source driver have a first polarity, and the data driving voltages transmitted via the even-numbered driving channels of the source driver have a second polarity.

A display device is provided in the present invention. The display device includes a display panel, a first source driver and a second source driver. The display panel includes 2N pixel cells on each of a plurality of scan lines, wherein N is a positive integer. Each of the first source driver and the second source driver includes a plurality of driving channels. The $1^{st}$ driving channel and the $N^{th}$ driving channel of the first source driver and the $1^{st}$ driving channel to the $N^{th}$ driving channel of the second source driver drive the 2N pixel cells on a first scan lines of the scan lines during a first scan period, while the $(N+1)^{th}$ driving channel of the first source driver and the $(N+1)^{th}$ driving channel of the second source driver are de-activated. The $2^{nd}$ driving channel to the $(N+1)^{th}$ driving channel of the first source driver and the $2^{nd}$ driving channel to the $(N+1)^{th}$ driving channel of the second source driver drive the 2N pixel cells on a second scan lines of the scan lines during a second scan period, while the $1^{st}$ driving channel of the first source driver and the $1^{st}$ driving channel of the second source driver are de-activated. The $(N+1)^{th}$ driving channel of the first source driver and the $1^{st}$ driving channel of the second source driver are connected.

In an embodiment of the foregoing display device, the odd-numbered driving channels of the driving channels of the first source driver and the second source driver output a plurality of data driving voltages of a first polarity, and the even-numbered driving channels of the first source driver and the second source driver output a plurality of data driving voltages of a second polarity.

The present invention provides the source driver and the driving method thereof that drive the N pixel cells on the first scan line of the display panel by the $1^{st}$ driving channel to the $N^{th}$ driving channel during the first scan period, and drive the N pixel cells on the second scan line of the display panel by the $2^{nd}$ driving channel to the $(N+1)^{th}$ driving channel during the second scan period. As for a certain driving channel, the driving channel sequentially outputs the driving voltages to the serrated-scanned pixel cells in two adjacent columns during different scan periods. Each driving channel is responsible for outputting the driving voltages with same polarity during different scan periods so as to perform dot inversion on the display device. Besides, the power consumption of the source driver can be reduced thereby.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
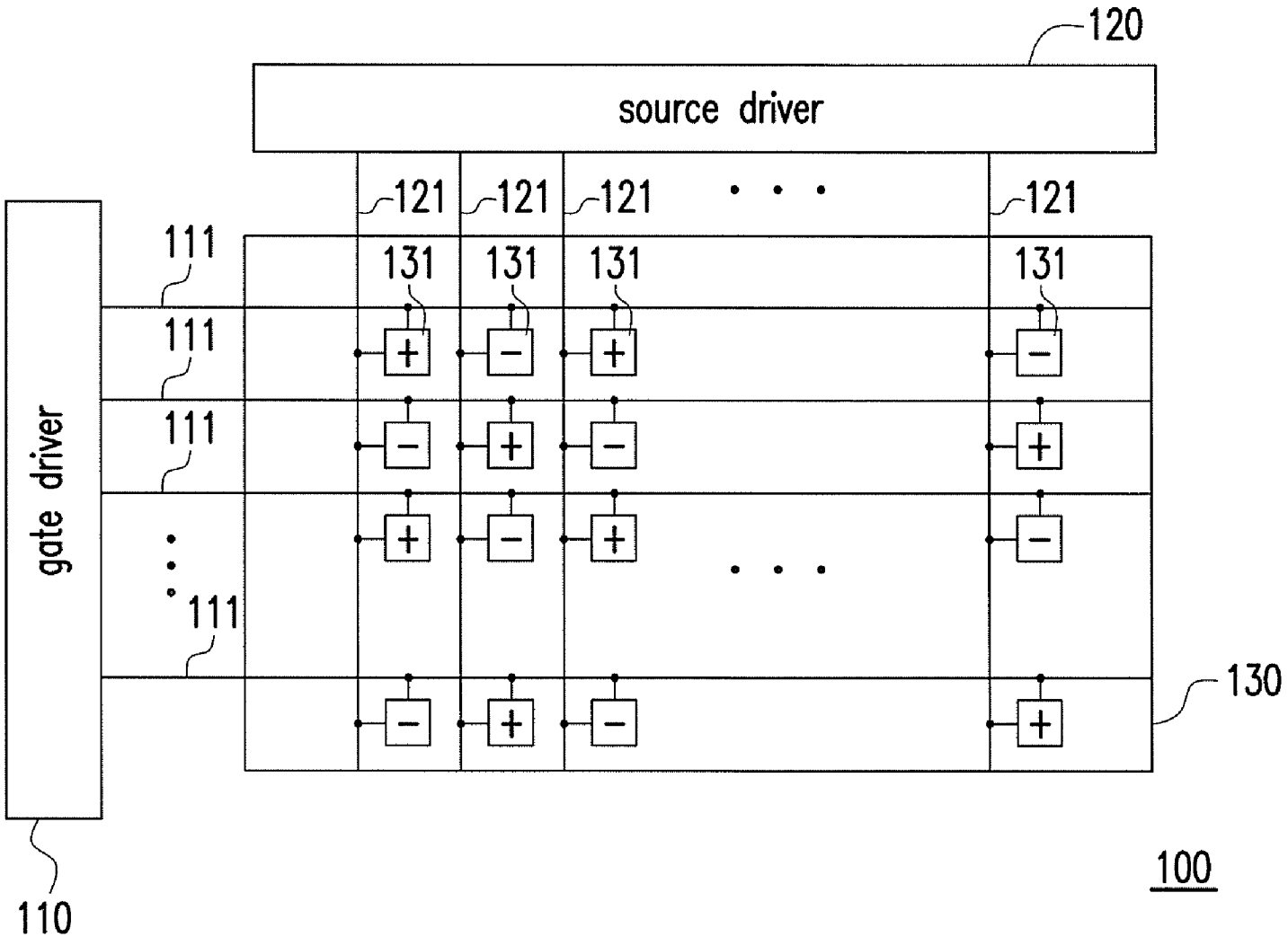
FIG. 1 (PRIOR ART)
FIG. 1 is a schematic diagram of a liquid crystal display (LCD) device.
Figure 2A:
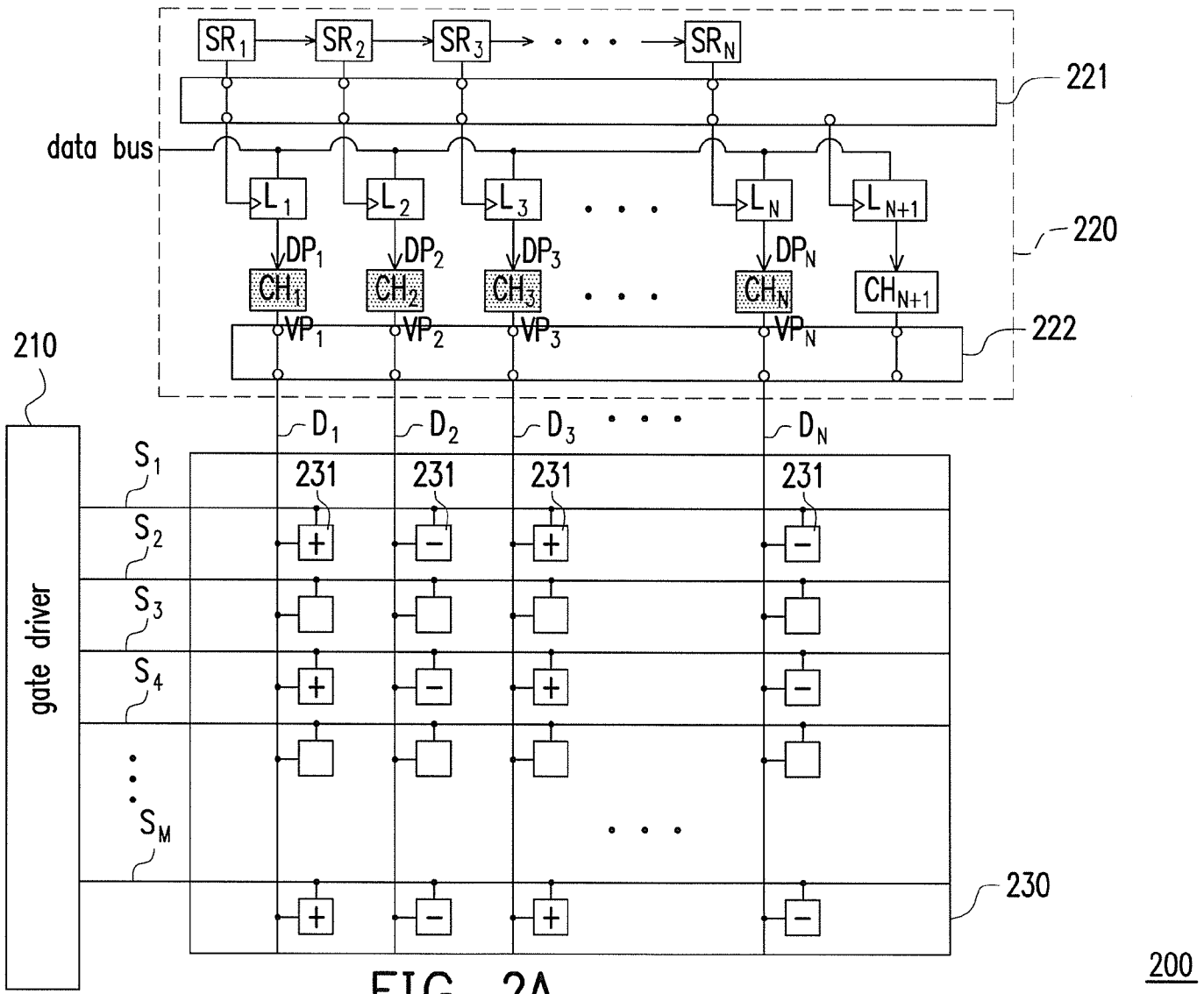
FIG. 2A and FIG. 2B are diagrams of a display device driven during a first scan period and during a second scan period respectively according to an embodiment of the present invention.
Figure 2B:
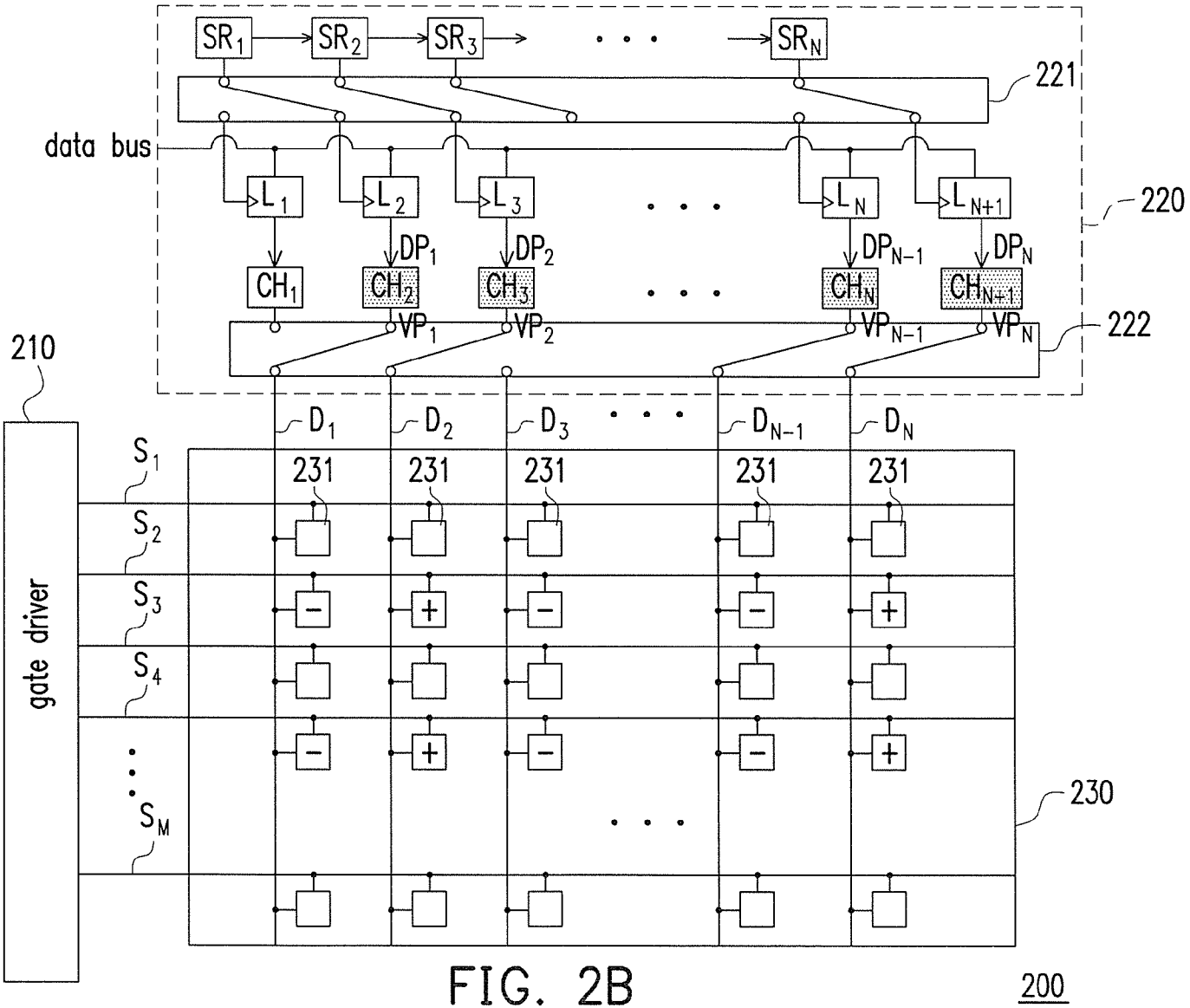

FIG. 2A and FIG. 2B are diagrams of a display device driven during a first scan period and during a second scan period respectively according to an embodiment of the present invention. Referring to FIG. 2A and FIG. 2B, the display device 200 includes a gate driver 210, a source driver 220 and a display panel 230. The display panel 230 includes a plurality of pixel cells 231 arranged in array manner, and each pixel cell 231 is coupled to one of the scan lines $S_1$ through $S_M$, and one of the data lines $D_1$ through $D_N$. There are N pixel cells 231 on each of the scan lines $S_1$ through $S_M$. The source driver 220 includes a plurality of driving channels $CH_1$ through $CH_{N+1}$, a plurality of shift registers $SR_1$ through $SR_N$, a plurality of data latches $L_1$ through $L_{N+1}$, a shift multiplexer 221 and an output multiplexers 222. There are N driving channels $CH_1$ through $CH_N$ plus an auxiliary driving channel $CH_{N+1}$ in the embodiment for driving the display panel 230, so do the data latches, but it is not limited to the number of the driving channels.

In the embodiment, one-dot inversion is performed on the display device 200. Namely, two adjacent pixel cells 231 are driven by the driving voltages with different polarities, e.g. positive polarity (denoted as "+") and negative polarity (denoted as "−"). Referring to FIG. 2A, the $1^{st}$ driving channel $CH_1$ to the $N^{th}$ driving channel $CH_N$ respectively drive the N pixel cells 231 on a first scan line of the scan lines $S_1$ through $S_M$, e.g. the scan line $S_1$, during a first scan period, wherein the first scan period is the period which the scan line $S_1$ is asserted by the gate driver 210. At present, the odd-numbered driving channels $CH_1$, $CH_3$, $CH_5$ . . . respectively output the data driving voltages $VP_1$, $VP_3$, $VP_5$ . . . of a first polarity, e.g. positive polarity, to the odd-numbered pixel cells 231 on the scan line $S_1$. Besides, the even-numbered driving channels $CH_2$, $CH_4$, $CH_6$ . . . respectively output the data driving voltages $VP_2$, $VP_4$, $VP_6$ . . . of a second polarity, e.g. negative polarity, to the even-numbered pixel cells 231 on the scan line $S_1$. The driving channel $CH_{N+1}$ can be de-activated since the data latch $L_{N+1}$ is not activated by any shift register and the driving channel $CH_{N+1}$ is not coupled to the data line through the output multiplexer 222.

During the first scan period, the shift registers $SR_1$ through $SR_N$ control the $1^{st}$ driving channel $CH_1$ to the $N^{th}$ driving channel $CH_N$ to respectively receive the pixel data $DP_1$ through $DP_N$ corresponding to the N pixel cells 231 on the scan line $S_1$ by the switching operation of the shift multiplexer 221. Namely, the shift registers $SR_1$ through $SR_N$ sequentially activate the data latches $L_1$ through $L_N$ to receive the pixel data $DP_1$ through $DP_N$ from a data bus. People ordinary skilled in the art realize that each driving channel of the source driver 220 may include the components, such as, level shifter, digital-to-analog converter, output buffer, and etc. The digital-to-analog converters included in the driving channels $CH_1$ through $CH_N$ respectively convert the pixel data $DP_1$ through $DP_N$ into the driving voltages $VP_1$ through $VP_N$. Then, the driving channels $CH_1$ through $CH_N$ respectively output the driving voltages $VP_1$ through $VP_N$ to the N pixel cells 231 via the output multiplexer 222.

Referring to FIG. 2B, the $2^{nd}$ driving channel $CH_2$ to the $(N+1)^{th}$ driving channel $CH_{N+1}$ drive the N pixel cells 231 on a second scan line of the scan lines $S_1$ through $S_M$, e.g. the scan line $S_2$, during a second scan period, wherein the second scan period is the period which the scan line $S_2$ is asserted by the gate driver 210. In the meanwhile, the even-numbered driving channels $CH_2$, $CH_4$, $CH_6$ . . . respectively output the data driving voltages $VP_1$, $VP_3$, $VP_5$ . . . of the second polarity, e.g. negative polarity, to the odd-numbered pixel cells 231 on the scan line $S_2$. Besides, the odd-numbered driving channels $CH_3$, $CH_5$ . . . except the driving channel $CH_1$ respectively output the data driving voltages $VP_2$, $VP_4$, $VP_6$ . . . of the first polarity, e.g. positive polarity, to the even-numbered pixel cells 231 on the scan line $S_2$. The driving channel $CH_1$ can be de-activated since the data latch $L_1$ is not activated by any shift register and the driving channel $CH_1$ is not coupled to the data line through the output multiplexer 222.

During the second scan period, the shift registers $SR_1$ through $SR_N$ control the $2^{nd}$ driving channel $CH_2$ to the $(N+1)^{th}$ driving channel $CH_{N+1}$ to respectively receive the pixel data $DP_1$ through $DP_N$ corresponding to the N pixel cells 231 on the scan line $S_2$ by the switching operation of the shift multiplexer 221. Namely, the shift registers $SR_1$ through $SR_N$ sequentially activate the data latches $L_2$ through $L_{N+1}$ to receive the pixel data $DP_1$ through $DP_N$ from the data bus. The digital-to-analog converters included in the driving channels $CH_2$ through $CH_{N+1}$ respectively convert the pixel data $DP_1$ through $DP_N$ into the driving voltages $VP_1$ through $VP_N$. Then, the driving channels $CH_2$ through $CH_{N+1}$ respectively output the driving voltages $VP_1$ through $VP_N$ to the N pixel cells 231 via the output multiplexer 222.

When the scan line $S_3$ follows the scan line $S_2$ to be asserted by the gate driver 210, the operation of the driving channels $CH_1$ through $CH_{N+1}$ during the asserted period of the scan line $S_3$ is similar to the operation of FIG. 2A. Besides, when the scan line $S_4$ follows the scan line $S_3$ to be asserted by the gate driver 210, the operation of the driving channels $CH_1$ through $CH_{N+1}$ during the asserted period of the scan line $S_4$ is similar to the operation of FIG. 2B. To reason by analogy, one-dot inversion can be performed on the display device 200. Although the said embodiment takes one-dot inversion as an example to describe, people ordinarily skill in the art can perform two-dot inversion or other kind inversion according to the teaching of the said embodiment so that the present invention should not be limited thereto.

As above-mentioned, each driving channel is responsible for outputting the driving voltages with same polarity during different scan periods. For example, the driving channel $CH_2$ outputs the driving voltage $VP_2$ with positive polarity during the first scan period, and outputs the driving voltage $VP_1$ with positive polarity during the second scan period. The voltage swing range between the driving voltages with same polarity is small so that the power consumption of the source driver 220 can be reduced, so does the temperature of the display device 200.

It is noted that, among the N pixel cells 231 on each scan line, every three sequentially pixel cells, which respectively correspond to red, green and blue, often serve as one pixel perceived by human, that is, N is a multiple of 3. As a result, every three sequential driving channels of the driving channels $CH_1$ through $CH_N$ should respectively output the data driving voltages corresponding to red, green and blue during the first scan period. Every three sequential driving channels of the driving channels $CH_2$ through $CH_{N+1}$ should respectively output the data driving voltages corresponding to red, green and blue during the second scan period. Since the number of the driving channels in one source driver may not be sufficient for the display panel as the increase of display panel size. Designer must employ a plurality of source drivers for driving such display panel. The following embodiment gives the teaching of driving the display panel with high resolution by utilizing several source drivers described above for people ordinary skilled in the art.

Figure 3A:
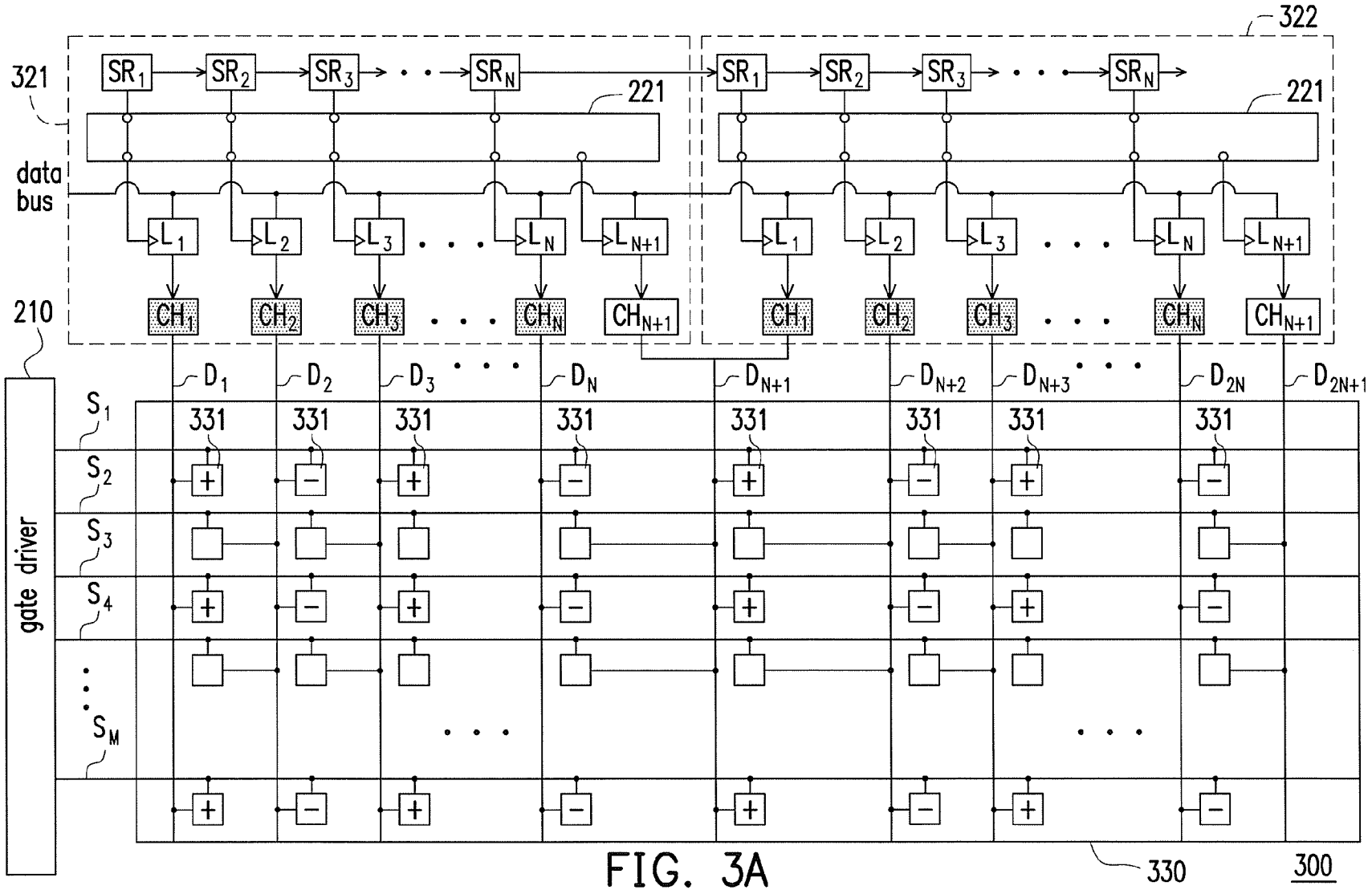
FIG. 3A and FIG. 3B are diagrams of a display device according to an embodiment of the present invention.
Figure 3B:
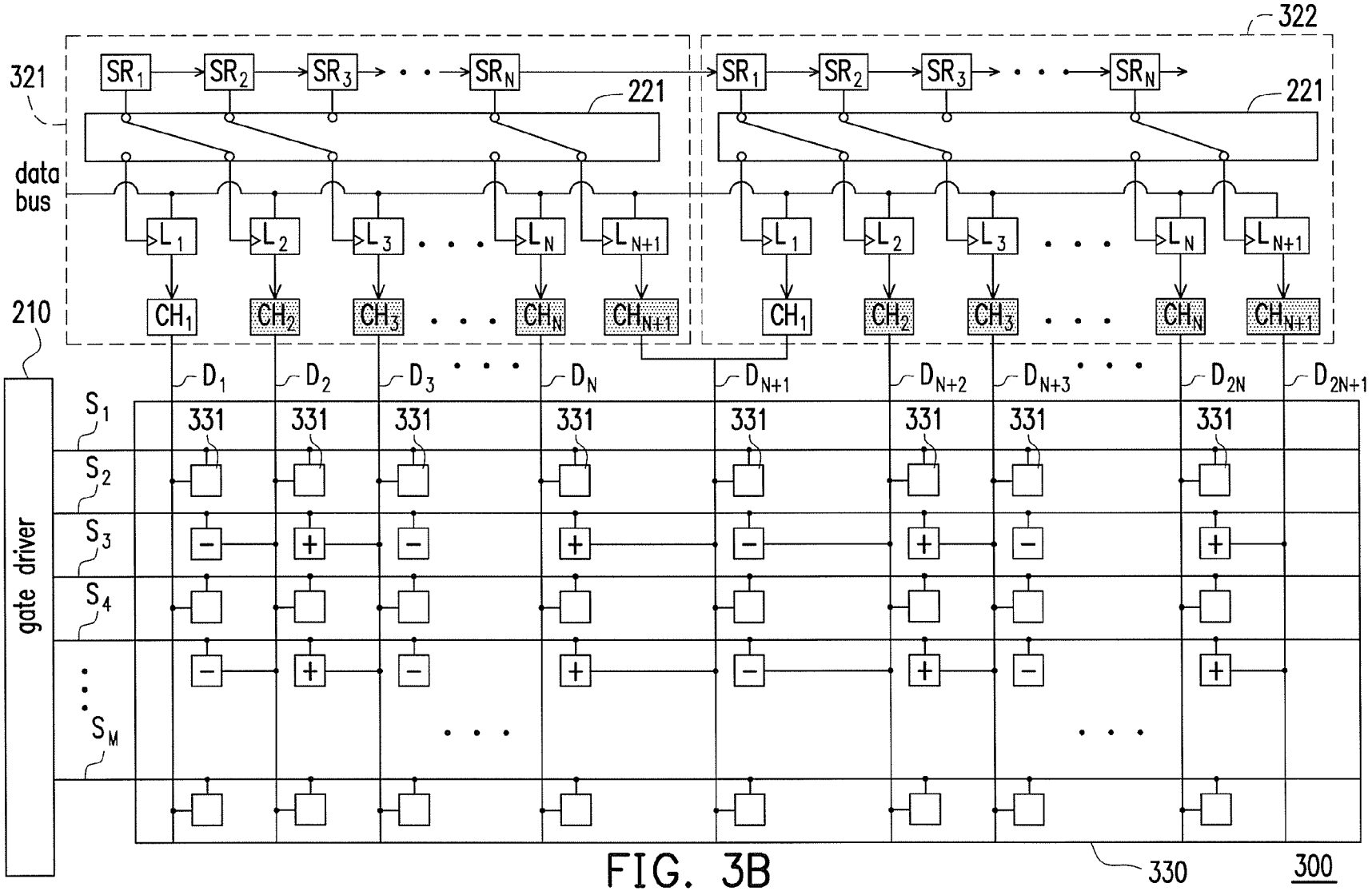

FIG. 3A and FIG. 3B are diagrams of a display device according to an embodiment of the present invention. Referring to FIG. 3A, the display device 300 includes a gate driver 210, the source drivers 321 and 322, and a display panel 330. The display panel 330 includes a plurality of scan lines $S_1$ through $S_M$, a plurality of data lines $D_1$ through $D_{2N+1}$, and a plurality of pixel cells 331 arranged in array manner. There are 2N pixel cells 331 on each scan line, which are exemplary two times as the size of the display panel 220 in FIG. 2A and FIG. 2B, wherein 2N is a multiple of 3, and every three sequential pixel cells 331 correspond to red, green and blue respectively. The 2N pixel cells 331 on a first scan line, e.g. the scan line $S_1$, are respectively coupled to the $1^{st}$ data line $D_1$ to the $2N^{th}$ data line $D_{2N}$, and the 2N pixel cells 331 on a second scan line, e.g. the scan line $S_2$, are respectively coupled to the $2^{nd}$ data line $D_2$ to the $(2N+1)^{th}$ data line $D_{2N+1}$. Each of the source drivers 321 and 322 includes a plurality of driving channels $CH_1$ through $CH_{N+1}$, a plurality of shift registers $SR_1$ through $SR_N$, a plurality of data latches $L_1$ through $L_{N+1}$, and a shift multiplexer 321, wherein the $(N+1)^{th}$ driving channel $CH_{N+1}$ of the source driver 321 is connected to the $1^{st}$ driving channel $CH_1$ of the source driver 322.

Referring to FIG. 3A, during a first scan period, the $1^{st}$ driving channel $CH_1$ to the $N^{th}$ driving channel $CH_N$ of the source driver 321 and the $1^{st}$ driving channel $CH_1$ to the $N^{th}$ driving channel $CH_N$ of the source driver 322 respectively drive the 2N pixel cells 331 on the scan line $S_1$, while the $(N+1)^{th}$ driving channel $CH_{N+1}$ of the source driver 321 and the $(N+1)^{th}$ driving channel $CH_{N+1}$ of the source driver 322 are de-activated. In the meanwhile, both of the $(N+1)^{th}$ driving channels $CH_{N+1}$ in the source driver 321 and 322 are set in high impendence for ensuring the correctness of signal transmission. Namely, the pixel cell 331 on the scan line $S_1$, which is coupled to the $(N+1)^{th}$ data line $D_{N+1}$, should be driven by the $1^{st}$ driving channel $CH_1$ of the source driver 322 during the first scan period, not the $(N+1)^{th}$ driving channels $CH_{N+}1$ of the source driver 321.

Taking the source driver 321 as an example, during the first scan period, by the switching operation of the shift multiplexer 221, the shift registers $SR_1$ through $SR_N$ sequentially activate the data latches $L_1$ through $L_N$ to receive the pixel data $DP_1$ through $DP_N$ from the data bus for controlling the $1^{st}$ driving channel $CH_1$ to the $N^{th}$ driving channel $CH_N$ to respectively receive the pixel data $DP_1$ through $DP_N$ corresponding to the $1^{st}$ pixel cell 331 to the $N^{th}$ pixel cell 331 on the scan line $S_1$. The driving channels $CH_1$ through $CH_N$ utilize the digital-to-analog converters to convert the pixel data $DP_1$ through $DP_N$ into the driving voltages $VP_1$ through $VP_N$ and then to output the driving voltages $VP_1$ through $VP_N$ to the $1^{st}$ pixel cell 331 to the $N^{th}$ pixel cell 331 via the data lines $D_1$ through $D_N$. The operation of the source driver 322 during the first scan period is similar to the operation of the source driver 321 during the first scan period, so that the detail is not iterated.

Referring to FIG. 3B, during a second scan period, the $2^{nd}$ driving channel $CH_2$ to the $(N+1)^{th}$ driving channel $CH_{N+1}$ of the source driver 321 and the $2^{nd}$ driving channel $CH_2$ to the $(N+1)^{th}$ driving channel $CH_{N+1}$ of the source driver 322 respectively drive the 2N pixel cells 331 on the scan line $S_2$, while the $1^{st}$ driving channel $CH_1$ of the source driver 321 and the $1^{st}$ driving channel $CH_1$ of the source driver 322 are de-activated. Similarly, the pixel cell 331 on the scan line $S_2$, which is coupled to the $(N+1)^{th}$ data line $D_{N+1}$, should be driven by the $(N+1)^{th}$ driving channels $CH_{N+1}$ of the source driver 321 during the second scan period, not the $1^{st}$ driving channel $CH_1$ of the source driver 322.

Taking the source driver 321 as an example, during the second scan period, by the switching operation of the shift multiplexer 221, the shift registers $SR_1$ through $SR_N$ sequentially activate the data latches $L_2$ through $L_{N+1}$ to receive the pixel data $DP_1$ through $DP_N$ from the data bus for controlling the $2^{nd}$ driving channel $CH_2$ to the $(N+1)^{th}$ driving channel $CH_{N+1}$ to respectively receive the pixel data $DP_1$ through $DP_N$ corresponding to the $1^{st}$ pixel cell 331 to the $N^{th}$ pixel cell 331 on the scan line $S_2$. The driving channels $CH_2$ through $CH_{N+1}$ utilize the digital-to-analog converters to convert the pixel data $DP_1$ through $DP_N$ into the driving voltages $VP_1$ through $VP_N$ and then to output the driving voltages $VP_1$ through $VP_N$ to the $1^{st}$ pixel cell 331 to the $N^{th}$ pixel cell 331 via the data lines $D_2$ through $D_{N+1}$. The operation of the source driver 322 during the second scan period is similar to the operation of the source driver 321 during the second scan period, so that the detail is not iterated.

In summary, the said embodiments describe the source driver that includes the driving channels to the number of N+1 for driving the N pixel cells on each scan line during different scan periods. Each driving channel of the source driver is responsible for outputting the driving voltages with same polarity, e.g. positive polarity or negative polarity, so that the power consumption of the source driver can be reduced. Besides, dot inversion can be simply performed on the display device for obtaining high display quality.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A display device, comprising:

a display panel, comprising 2×N pixel cells on each of a plurality of the scan lines, wherein N is a positive integer; and a first source driver and a second source driver, each source driver comprising a plurality of driving channels, the $1^{st}$ driving channel to the $N^{th}$ driving channels of the first source driver and the $1^{st}$ driving channel to the $N^{th}$ driving channel of the second source driver respectively drives the 2×N pixel cells on a first scan line of the scan lines during a first scan period while the $(N+1)^{th}$ driving channel of the first source driver and the $(N+1)^{th}$ driving channel of the second source driver are de-activated, the $2^{nd}$ driving channel to the $(N+1)^{th}$ driving channel of the first source driver and $2^{nd}$ driving channel to the $(N+1)^{th}$ driving channel of the second source driver respectively drives the 2×N pixel cells on a second scan line of the scan lines during a second scan period while the $1^{st}$ driving channel of the first source driver and the $1^{st}$ driving channel of the second source driver are de-activated, wherein the $(N+1)^{th}$ driving channel of the first source driver is connected to the $1^{st}$ driving channel of the second source driver.

2. The display device as claimed in claim 1, wherein the odd-numbered driving channels of each source driver respectively output a plurality of data driving voltages of a first polarity, and the even-numbered driving channels of each source driver respectively output a plurality of data driving voltage of a second polarity.

3. The display device as claimed in claim 1, wherein the first source driver further comprises:

a plurality of shift registers, coupled in series for controlling the $1^{st}$ driving channel to the $N^{th}$ driving channel of the first source driver to receive a plurality of pixel data corresponding to the $1^{st}$ pixel cell to the $N^{th}$ pixel cell on the first scan line during the first scan period, and for controlling the $2^{nd}$ driving channel to the $(N+1)^{th}$ driving channel of the first source driver to receive the pixel data corresponding to the $1^{st}$ pixel cell to the $N^{th}$ pixel cell on the second scan line during the second scan period.

4. The display device as claimed in claim 1, wherein the second source driver further comprises:

a plurality of shift registers, coupled in series for controlling the $1^{st}$ driving channel to the $N^{th}$ driving channel of the second source driver to receive a plurality of pixel data corresponding to the $(N+1)^{th}$ pixel cell to the $(2\times N)^{th}$ pixel cell on the first scan line, and for controlling the $2^{nd}$ driving channel to the $(N+1)^{th}$ driving channel of the second source driver to receive the pixel data corresponding to the $(N+1)^{th}$ pixel cell to the $(2\times N)^{th}$ pixel cell on the second scan line.

5. The display device as claimed in claim 1, wherein the first scan period is the asserted period of the first scan line and the second scan period is the asserted period of the second scan line.

6. The display device as claimed in claim 1, wherein 2×N is a multiple of 3.

7. The display device as claimed in claim 1, wherein the first scan line is one of the odd-numbered scan lines, and the second scan line is one of the even-numbered scan lines.

8. The display device as claimed in claim 1. wherein the display panel comprises a plurality of data lines coupled to the driving channels of each source driver respectively, the 2×N pixel cells on the first scan line are respectively coupled to the $1^{st}$ data line to the $2\times N^{th}$ data line, and the 2×N pixel cells on the second scan line are respectively coupled to the $2^{nd}$ data line to the $(2\times N+1)^{th}$ data line.

* * * * *